US006990785B2

(12) United States Patent
Wild et al.

(10) Patent No.: US 6,990,785 B2
(45) Date of Patent: Jan. 31, 2006

(54) DRINKING STRAW ATTACHMENT DEVICE AND METHOD

(75) Inventors: Hans-Peter Wild, Zug (CH); Eberhard Kraft, Neckarbischofsheim (DE)

(73) Assignee: Indag Gesellschaft fuer Industriebedarf mbH & CO Betriebs KG, Eppelheim (DE)

( * ) Notice: Subject to any disclaimer, the term of this patent is extended or adjusted under 35 U.S.C. 154(b) by 94 days.

(21) Appl. No.: 10/085,282

(22) Filed: Feb. 28, 2002

(65) Prior Publication Data

US 2002/0144488 A1 Oct. 10, 2002

(30) Foreign Application Priority Data

Mar. 1, 2001 (DE) ..... 101 09 875

(51) Int. Cl.
*B65B 61/00* (2006.01)
*B65B 61/20* (2006.01)

(52) U.S. Cl. ..... 53/410; 53/133.1; 53/136.1

(58) Field of Classification Search ..... 53/133.1, 53/133.2, 136.1, 154, 155, 168, 202, 237, 53/238, 239, 410, 445, 474
See application file for complete search history.

(56) References Cited

U.S. PATENT DOCUMENTS

| | | | |
|---|---|---|---|
| 4,584,046 A | 4/1986 | Geyssel | |
| 4,707,965 A | 11/1987 | Becker | |
| 5,597,089 A | 1/1997 | Smith | |
| 5,979,142 A | 11/1999 | Kraft et al. | |

FOREIGN PATENT DOCUMENTS

| | | |
|---|---|---|
| CL | 1317-94 | 4/1991 |
| DE | 3532839 | 9/1985 |
| DE | 19745855 | 10/1997 |
| EP | 0 085895 | 1/1983 |
| EP | 0698564 A1 | 2/1996 |
| JP | 07-205941 A1 | 8/1995 |
| JP | 11-193011 A1 | 7/1999 |
| NZ | 9402915 | 1/1995 |
| NZ | 280530 | 7/1998 |

*Primary Examiner*—John Paradiso
(74) *Attorney, Agent, or Firm*—Marshall, Gerstein & Borun LLP

(57) ABSTRACT

A drinking straw attachment device for attaching drinking straws to beverage containers, wherein the drinking straws are fed in the form of a drinking straw band provided with a glue layer, with a feeder device having, at least the point where the cutting device severs two drinking straws from each other, a recess matched in its height position with the glue layer and the height extension of which corresponds at least to the width of the glue layer. A method for attaching drinking straws to beverage containers includes cutting device drinking straw band into pieces between each of the two drinking straws with a cutting device in the area of the feeder device, and piercing the cutting device through the glue layer and the drinking straw band into a recess provided on the feeder device in a height position corresponding to the glue layer, and whereby the height extension of the recess corresponds at least to the width of the glue band.

20 Claims, 4 Drawing Sheets

DRINKING STRAW ATTACHMENT DEVICE AND METHOD

FIELD OF THE INVENTION

The invention relates to a drinking straw attachment device for attaching drinking straws to beverage containers as well as to a corresponding method.

BACKGROUND OF THE INVENTION

A drinking straw attachment device serves in an automatic beverage bottling plant to attach a drinking straw to a beverage container, e.g. to a filled and sealed foil bag at the end of the bottling process. Such foil bags are, for instance, formed from two rectangular foils sealed together on three edges with a base foil being heat-sealed between the fourth edges of the foil bags. To remove the beverage, a drinking straw is pierced through one of the side foils or through a corresponding insert.

With the aid of a feeder device, the drinking straws in the form of a continuous string are moved guided towards the beverage containers which are transported on a corresponding conveyor belt. In doing so, the drinking straws of such a string are as a rule aligned vertically with respect to the conveyor belt. The individual drinking straws are either connected with a band that is detached or severed prior to being attached, or which are heat-sealed into the protective coverings, the edges of which being connected to form a drinking straw string which is severed on the heat-sealed edges prior to attachment to the beverage containers. The drinking straw is held onto the beverage container for instance by a glue previously applied to the beverage container or by a glue provided on the straw band.

In the latter case, the problem arises that a cutting device for severing the drinking straw band must penetrate through both the drinking straw band as well as through the glue. On the side of the drinking straw turned away from the cutting device, this results in conglutination on the drinking straw band or on a guide element possibly located there. Such conglutination entails malfunctioning in the gluing process and expensive cleaning procedures for the feeder device become frequently necessary.

SUMMARY OF THE INVENTION

The object of the present invention is, based on this state of the art, to provide a drinking straw attachment device and a drinking straw attachment method where the danger of such undesirable conglutination is reduced.

A drinking straw attachment device according to this invention comprises a feeder device for feeding the drinking straw band to the beverage container conveyor belt onto which the drinking straw band contacts a side which is not provided with a glue layer and whereby the feeder device at least where the cutting device severs two drinking straws from each other comprises in each case a recess matched in its height position to the glue layer and the height expansion of which corresponds at least to the width of the glue layer. With the drinking straw attachment device according to this invention the cutting device, e.g. a knife blade, penetrates through the drinking straw band and consequently through the glue layer as well, then it meets up, behind the drinking straw band where the glue layer is penetrated, with a corresponding recess. Since this recess corresponds to the glue layer at least in its height position and height expansion, the cutting device does not come in this area into contact with any other component of the feeder device. Consequently, conglutination does not occur which is caused by the glue sticking to the cutting device.

Advantageously such recesses can be used as a rotor as feeder device. Several drinking straws simultaneously come into contact with such a rotor. The recesses located in the area of the feeder device at the height of the glue layer can be mutually connected with each other so that a circular groove is formed on the circumference of the feeder rotor. Such a circular groove is easily manufactured and thus not expensive.

The cutting device in the simplest model comprises in such a case a knife that can be moved radially to the axis of the feeder rotor.

Advantageously the feeder device comprises vacuum devices which hold the individual drinking straws on the feeder device by means of vacuum pressure. In this way, expensive mechanical holder mechanisms can be avoided.

The drinking straws separated from each other can be pressed onto the beverage containers with the aid of a pressing device. Particularly even attachment of the drinking straws is achieved with two pressing devices which engage at the upper and lower portions of the drinking straw to be pressed-on.

In doing so it is possible that the pressing device engage above and below the feeder rotor on the drinking straws to be pressed-on. A particularly safe feed is, however, achieved if the feeder rotor comprises a extension in the axial direction corresponding at least to the height of a drinking straw and supporting the latter in its entire expansion. Consequently at the height of the pressing devices a second and a third circular groove is provided enabling free movement of the pressing device and the rotor.

To further increase the pressing-on precision and strength, a third pressing device can be provided which engages the drinking straw at the height of the glue layer. In such a case the first circular groove which is provided on the feeder rotor at the height of the glue layer can be designed such that the third pressing device protrudes into it and that the feeder rotor can still run freely. A further peripheral groove for receiving the third pressing device is consequently not necessary.

A particularly simple embodiment provides that the pressing devices of the feeder device are fingers pivotal around an axis which press each of the drinking straws against the beverage container with their end furthest away from the axis.

The drinking straw bands may be bands to which the drinking straws are attached. For hygienic reasons drinking straws heat-sealed in protective coverings are preferred. With drinking straws provided in a protective covering the corresponding protective coverings may therefore be designed such that they are connected on the rims in each case with an adjacent protective covering for another drinking straw so that in this way a band is formed.

The glue layer can be formed, for instance, by a glue band that is applied to the drinking straw band. Such a glue band is protected by a cover band that is removed prior to applying the glue band to the beverage container. Particularly advantageous is a transfer glue band where the glue is not held by an additional carrier material.

In order to increase the throughput, it may be provided that two drinking straw attachment stations each with a feeder device, a cutting device and a corresponding number of pressing devices are provided which alternately provide the beverage containers being moved past the feeder devices with drinking straws.

BRIEF DESCRIPTION OF THE DRAWINGS

Here below, a special embodiment of such a drinking straw attachment device described in this invention will be explained with the help of a beverage foil bag.

DETAILED DESCRIPTION OF THE INVENTION

Figure 1:
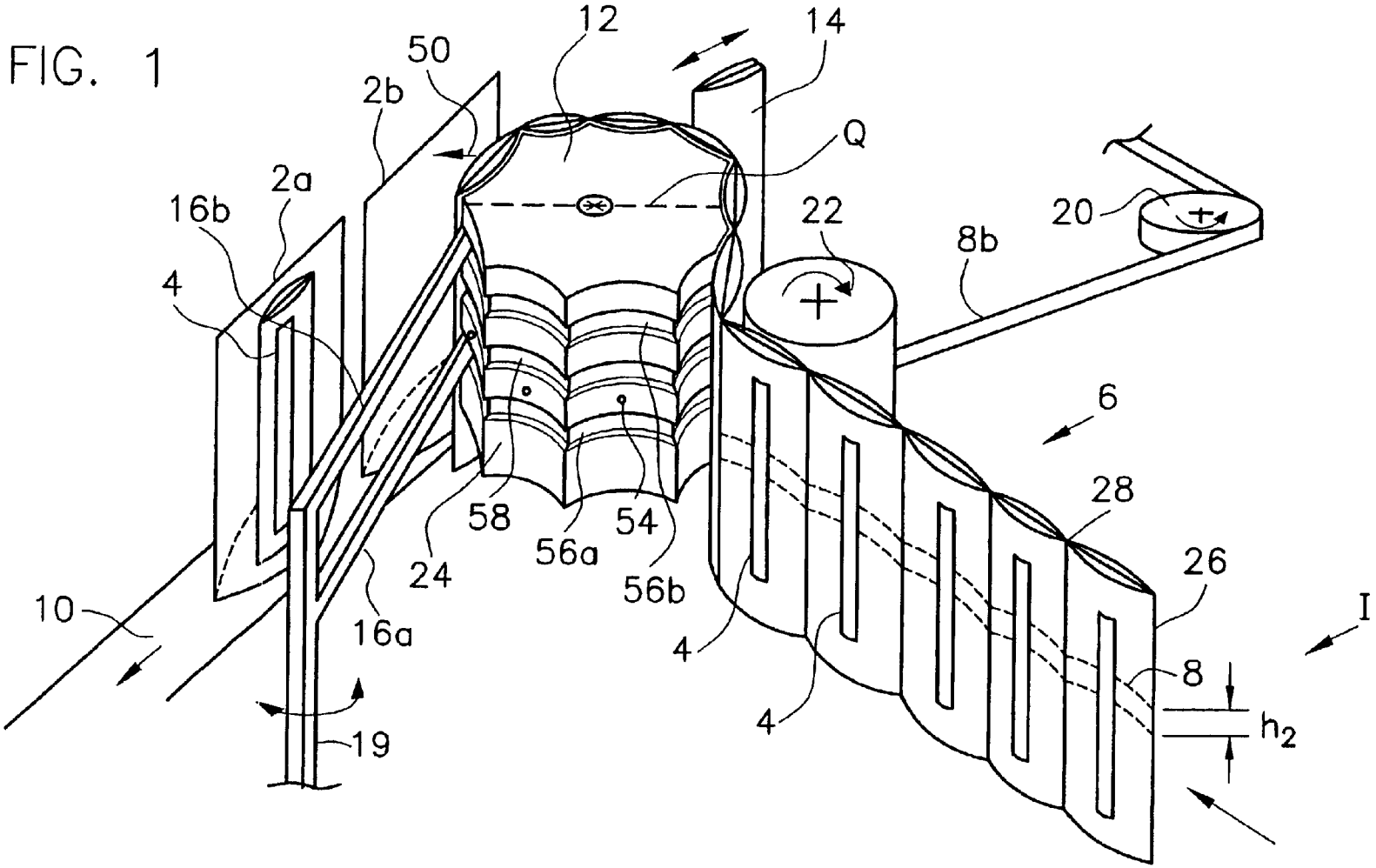
FIG. 1 shows in perspective the attachment area of a drinking straw attachment device according to the invention.
Figure 4:
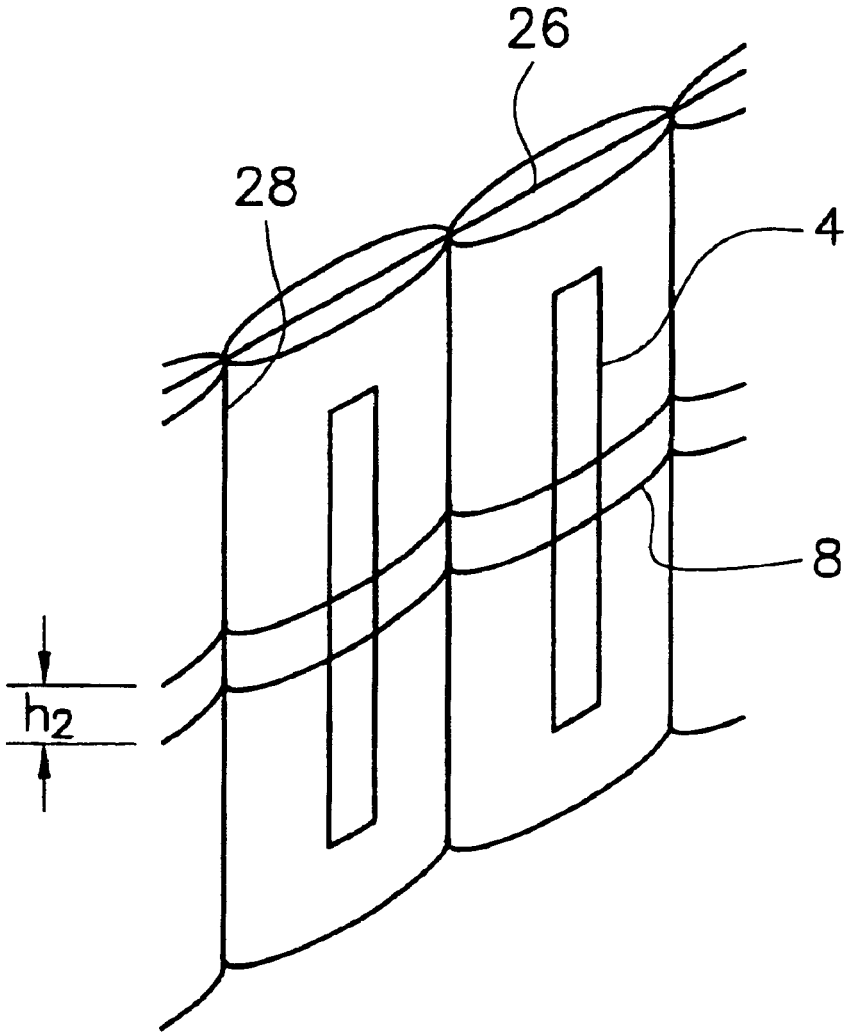
FIG. 4 shows a section of a drinking straw band in viewing direction I in FIG. 1.

A preferred embodiment of the drinking straw attachment device according to this invention is shown in FIG. 1. Filled and closed beverage containers 2 are, for instance, fed on a conveyor belt along the feeder device. Here 2*b* shows a beverage container which has not yet been provided with a drinking straw while 2*a* shows a foil bag which has already been provided with a drinking straw 4. A drinking straw band 6 is guided by deflection pulleys 22. The drinking straw band 6 encompasses in the preferred embodiment drinking straws 4 which are heat-sealed into a protective covering 26. By means of vertical heat-seal seams 28 the individual drinking straws are separated from each other. On the one side of the drinking straw band a transfer glue band 8 has been applied with a height h2. A view of the drinking straw band 6 showing the transfer glue band 8 is shown in FIG. 4. The transfer glue band 8 has been covered with a cover band 8*b* which is pulled off by a deflection pulley 20.

Reference numeral 12 denotes a feeder rotor with recesses 24 whose shape is adapted to the drinking straws or the drinking straws in protective coverings. Number 54 shows the vacuum holes which upon application of vacuum hold the drinking straws to the feeder rotor 12. The feeder rotor 12 is equipped with two peripheral grooves 56*a* and 56*b*. A further circular groove 58 is located between the two other circular grooves at a height corresponding to glue band 8. A knife 14, movable radially in relation to the axis of the feeder rotor 12, serves to sever the drinking straw band 6. At the point where the knife 14 meets the feeder rotor 12 in severing the drinking straw band 6, a narrow vertically extending groove can be provided in the rotor for receiving the knife, this groove not being shown in FIG. 1 for reasons of visual clarity.

Reference numerals 16*a* and 16*b* indicate pressing devices pivotally supported around an axis 19. Arrow direction 50 indicates in which direction the individual drinking straws are moved through the pressing devices 16*a* and 16*b*. The grooves 56*b* and 56*a* between the feeder rotor 12 have been chosen in regard to their dimensions such that the feeder rotor 12 can rotate without being obstructed by the pressing devices 16*a* and 16*b* which protrude into the grooves 56*b* and 56*a*.

Figure 2:
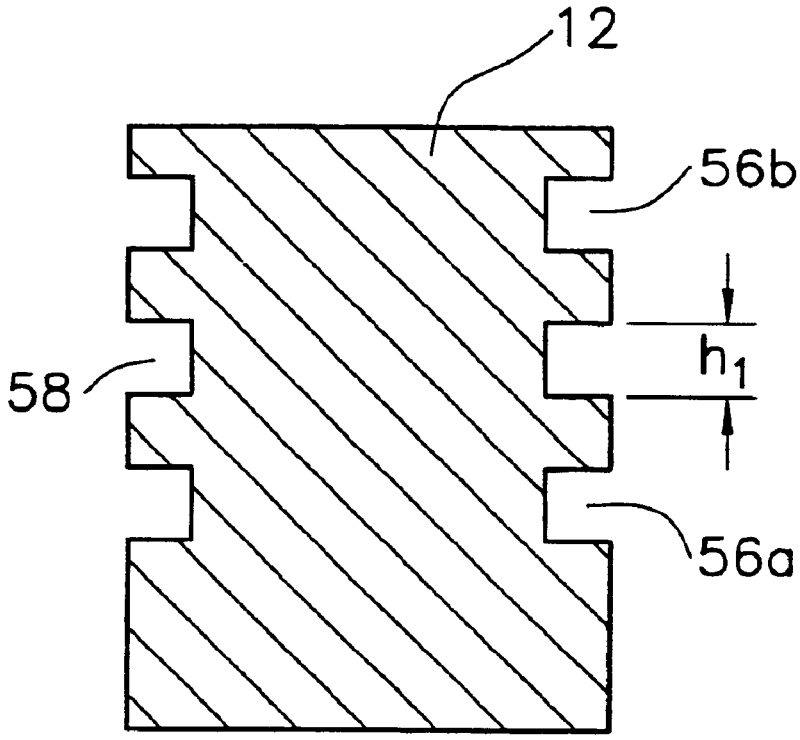
FIG. 2 shows a cross-section e.g. along the line Q in FIG. 1 of a feeder device according to a preferred embodiment of the drinking straw attachment device according to the invention.

FIG. 2 shows a cross-section through the feeder rotor 12 approximately along the line Q in FIG. 1. The height of the middle groove 58 is designated by h1 and is greater than the height h2 of the glue band 8.

Figure 3:
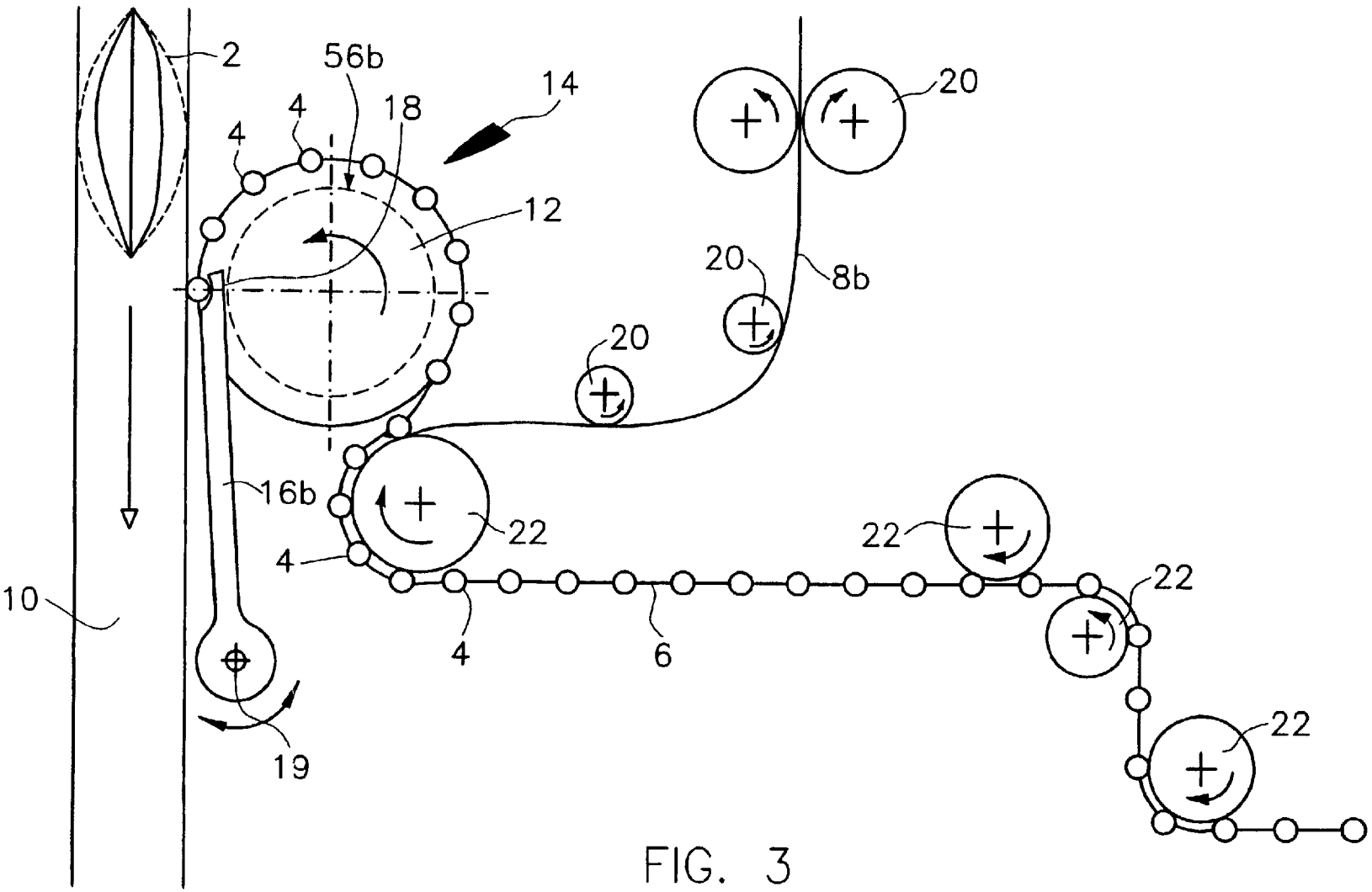
FIG. 3 shows a roughly schematic top view of the area described in FIG. 1.

FIG. 3 shows a roughly schematic top view of the feeder area of a drinking straw attachment device according to the invention. There 18 indicates the end remote from the axis of the pressing device 16*b*. The broken line suggests in which way this end remote from the axis 18 protrudes into groove 56*b* of the feeder rotor 12.

The beverage containers 2 are, for instance, made of aluminium laminate foil and have inserted bottom faces which unfold when filled so that the beverage containers 2 extend downwards and thus provide room for the beverage.

The Device Shown Operates as Follows:

As shown in FIG. 1 and FIG. 3, filled foil bags 2, 2*a* and 2*b* are fed from a bottling and closing system (not shown in closer detail) to the drinking straw attachment device with the aid of the conveyor belt 10. The beverage containers 2 are thereby aligned such that the side on which the drinking straw is to be attached in each case is facing the feeder device 12. Whenever a beverage container 2 passes the feeder rotor 12, either through definition of the corresponding interval or by means of a sensor device, which is not of interest in this case, motion of the pressing devices 16*a* and 16*b* around the swivel axis 19 is activated. In this way, the drinking straw 4 closest to this beverage container is pressed against the latter. The drinking straws 4 stick to the beverage containers 2 after the process of being pressed by the pressing devices 16*a* and 16*b* through the transfer glue band 8.

The drinking straws 4 are in this way fed in the following manner. The cover band 8*b* is pulled off from the glue layer 8 on the drinking straw band shortly before the corresponding part of the drinking straw band 6 reaches the feeder rotor. During feeding the drinking straw band 6 runs around various deflection pulleys 22 while the cover band 8*b* is led off by other deflection pulleys 20. The drinking straw band 6 without the cover band 8*b* runs against the feeder rotor 12 and is deflected there. The individual protective coverings of the drinking straws 4 thereby insert into the recesses 24. There they are held with the aid of a vacuum that is applied by the vacuum holes 54. The knife 14 moves in synch radially in the direction of the feeder rotor 12 and severs the drinking straw band 6 at the heat-seal seams 28.

In doing so, the knife 14 also penetrates through the transfer glue band 8. Since the peripheral groove 58 is located in the feeder rotor 12 on the level of the glue band 8, said groove having a width h2 which is greater than the width h1 of the transfer glue band 8, the knife 14 passes in the area in which it is likewise pushed through the transfer glue band 8 after severing of the drinking straw band 6 into an open space. Thus, when the drinking straw band 6 is cut, this does not result in conglutination of the feeder rotor 12 or the drinking straw band 6 which would affect the reliability of the drinking straw attachment device.

We claim:

1. Method for attaching drinking straws to beverage containers, comprising feeding the drinking straws in the form of a drinking straw band (6, 26) provided on one side with a glue layer (8) by a feeder device (12) to the beverage containers (2), severing the drinking straw band (6, 26) with a cutting device (14) in the area of the feeder device (12) between two drinking straws, piercing the cutting device (14) through the glue layer (8) and the drinking straw into a circumferential groove (58) provided on the feeder device (12) corresponding in its height position to the glue layer (8) and the height extension (h1) of which at least corresponds to the width (h2) of the glue band, and glueing the individual drinking straws onto the respective beverage containers.

2. Drinking straw attachment device for attaching drinking straws to beverage containers, wherein the drinking straws (4) are fed in the form of a drinking straw band (6, 26) which has been provided on a first side with a glue layer (8), the drinking straw attachment device comprising:

a conveyer device (10) for transporting the beverage containers (2) along a conveyor belt;

a feeder device (12) for feeding the drinking straw band (6, 26) to the conveyor belt, wherein the drinking straw band engages a second side on the feeder device (12) which has not been provided with a glue layer;

a cutting device (14) in the area of the feeder device (12) for severing the drinking straw band (6, 26) between two drinking straws (4) each; at least one pressing device (16*a*, 16*b*) for pressing a drinking straw (4) to a foil bag (2*b*) in such a manner that the drinking straw sticks with the glue layer (8) to the beverage container; and the feeder device (12) at least at any point where the cutting device (14) severs two drinking straws (4) from each other has at least a first circumferential groove which in its height position is matched to the glue layer (8) and whose height extension (h1) corresponds at least to the width (h2) of the glue layer.

3. A drinking straw attachment device according to claim 2, wherein the feeder device (12) is a rotor.

4. A drinking straw attachment device according to claim 3, wherein the feeder rotor includes a plurality of vertically formed recesses (24) formed around the periphery thereof, and wherein the first groove is a circumferential groove (58) provided at the height of the glue layer (8) on the circumference of the feeder rotor (12).

5. A drinking straw attachment device according to claim 3 or 4, wherein the cutting device comprises a knife (14) which can be moved radially to the axis of the feeder rotor (12).

6. A drinking straw attachment device according to claim 2, 3, or 4, wherein the feeder device (12) comprises vacuum devices (54) holding the drinking straws (4) by vacuum pressure to the feeder device.

7. A drinking straw attachment device as claimed on claim 2, 3, or 4, wherein the drinking straws (4) are heat-sealed into a protective covering (26) forming the drinking straw band and that the drinking straws (4) are separated from each other by a seal seam (28).

8. A drinking straw attachment device according to claim 2, wherein two pressing devices (16*a*, 16*b*) are provided which engage in the upper and lower area of the drinking straw (4) to be pressed-on.

9. A drinking straw attachment device as claimed in claim 8, wherein the feeder rotor (12) comprises an extension in the axial direction corresponding at least to the height of a drinking straw (4) and where at the height of the pressing devices (16*a*, 16*b*) a second and a third peripheral groove (56*a*, 56*b*) are provided.

10. A drinking straw attachment device as claimed in claim 9, wherein a third pressing device is provided at the height of the first peripheral groove (58).

11. A drinking straw attachment device as claimed in claim 10, wherein the pressing devices (16*a*, 16*b*) are fingers which can be pivoted around an axis (19) and which press against each of the drinking straws (4) with the end remote from the axis (18) on the corresponding beverage containers (2*b*).

12. A device as claimed on claim 2, wherein the glue layer comprises a transfer glue band (8) which has been applied in advance to the drinking straw band (6, 26).

13. A drinking straw attachment device as claimed in claim 2, wherein two drinking straw attachment stations are each provided with a feeder device (12), a cutting device (14) and a corresponding number of pressing devices (16*a*, 16*b*) which alternately provide the beverage containers (2*a*, 2*b*) with drinking straws (4).

14. An apparatus for attaching drinking straws to a beverage container comprising:

a plurality of straw packets formed in a straw band, the straw band having a glue band applied at a predetermined location; and a feeder device adapted to deliver individual straw packets to the beverage containers, the feeder device having at least one circumferential groove formed around the periphery thereof at a height corresponding to the location of the glue band.

15. The apparatus of claim 14 further comprising:

a press device having at least one finger extending into the at least one groove of the feeder device.

16. The apparatus of claim 15, wherein the press device rotates about a pivot to move individual straw packets from the feeder device to a corresponding beverage container.

17. The apparatus of claim 14, wherein the at least one groove includes an intermediate groove positioned proximate to the location of the glue band, the width of the intermediate groove being at least as wide as the width of the glue band.

18. The apparatus of claim 14 further comprising:

a plurality of vertical recesses formed on the feeder device, the recesses having a shape substantially similar to the shape of the individual straw packets.

19. The apparatus of claim 18 further comprising:

an aperture formed in each vertical recess for providing a vacuum to hold the individual straw packets adjacent the feeder device.

20. The apparatus of claim 14 further comprising:

a cutting tool operable for separating the individual straw packets from the straw band.

* * * * *